US006965322B2

(12) United States Patent
Metz et al.

(10) Patent No.: US 6,965,322 B2
(45) Date of Patent: Nov. 15, 2005

(54) TRAFFIC SIGNAL OPERATION DURING POWER OUTAGES

(75) Inventors: Eric A. Metz, P.O. Box 5841, San Bernardino, CA (US) 92412; Ramey B. Metz, Villa Park, CA (US)

(73) Assignee: Eric A. Metz, Ramona, CA (US)

( * ) Notice: Subject to any disclaimer, the term of this patent is extended or adjusted under 35 U.S.C. 154(b) by 54 days.

(21) Appl. No.: 10/621,722

(22) Filed: Jul. 18, 2003

(65) Prior Publication Data

US 2005/0012641 A1 Jan. 20, 2005

(51) Int. Cl.[7] ..... G08G 1/095
(52) U.S. Cl. ..... 340/907; 200/19.37
(58) Field of Search ..... 340/907–931, 340/333; 200/19.37; 116/63 R

(56) References Cited

U.S. PATENT DOCUMENTS

| | | | | |
|---|---|---|---|---|
| 2,166,721 A | | 7/1939 | Jeffers | |
| 3,596,239 A | | 7/1971 | Hata et al. | |
| 3,629,802 A | | 12/1971 | Clark et al. | |
| 3,648,233 A | | 3/1972 | Clark | |
| 3,778,762 A | | 12/1973 | Jarko et al. | |
| 3,902,156 A | | 8/1975 | Hill | |
| 4,024,528 A | | 5/1977 | Boggs et al. | |
| 4,135,145 A | | 1/1979 | Eberle | |
| 4,383,240 A | | 5/1983 | Staats, Jr. | |
| 4,566,008 A | | 1/1986 | Powers et al. | |
| 5,327,123 A | | 7/1994 | Heimann et al. | |
| 5,659,305 A | * | 8/1997 | Rains et al. | 340/931 |
| 6,268,805 B1 | * | 7/2001 | Simon | 340/907 |
| 6,329,904 B1 | * | 12/2001 | Lamb | 340/286.02 |
| 6,392,563 B1 | * | 5/2002 | Paquette et al. | 340/907 |
| 6,577,247 B2 | * | 6/2003 | Giacaman | 340/907 |

OTHER PUBLICATIONS

Section 6 Conflict Monitors pp. 45–56.

* cited by examiner

*Primary Examiner*—Jeffery Hofsass
*Assistant Examiner*—George A Bugg
(74) *Attorney, Agent, or Firm*—William W. Haefliger

(57) ABSTRACT

In a control system for controlling traffic signal lights, normally supplied with power from the AC source, the combination comprising flasher means electrically connectible to the lights to cause the lights to come ON and OFF, repeatedly, an electrical power storage device electrically connectible to the flasher means for supplying electrical power to operate the flasher means when AC source power is not supplied to the traffic control system, and a charging device for charging the storage device when AC power is normally supplied to the traffic control system.

38 Claims, 8 Drawing Sheets

VOLTAGE DISCON-NECTING DEVICE
~48~
VOLTAGE REDUCTION
~51~
FLASHING LOGIC
~54~
LOAD 1 POWER OUTPUT
LOAD 2 POWER OUTPUT
BACK-UP POWER CHARGING
~63~
VOLTAGE REROUT-ING
~64~
BACK-UP POWER STORAGE
~65~
R
Y
G
33
32a
34
35
36
32b
37
38
39
40
43
46
47
49
50
52
53
55
56
57
57a
58
58a
59
60
61
62
66
67
68
69
70
71
72
73
74
75
76

Vpeak

AC VOLTAGE WAVE FORM
AMPLITUDE
(VOLTAGE)
+
−
TIME
T

FLASHER OUTPUT WAVEFORM (LOAD 1)
T
TIME
AMPLITUDE
(VOLTAGE)
LOAD 1 POWER OUTPUT
0

FLASHER OUTPUT WAVEFORM (LOAD 2)
0
LOAD 2 POWER OUTPUT

WITH AC VOLTAGE ABOVE THRESHOLD

WITH AC VOLTAGE BELOW THRESHOLD

TRAFFIC SIGNAL OPERATION DURING POWER OUTAGES

BACKGROUND OF THE INVENTION

This invention relates generally to traffic control systems, and more particularly to improvements in operating traffic signal lights at controlled roadway intersections during times when loss of electrical power occurs.

At the present time traffic control systems use a controller unit that energizes load switches that drive the signal lamps through a flash transfer relay. In the event that a conflicting signal should arise, a conflict monitor actuates the relay to transfer the traffic signal loads to a flasher module. When this transfer occurs, the controller unit and load switches are removed from causing the traffic signal lights to be turned ON and to be turned OFF. Once the relay is actuated to transfer the traffic signal loads to the flasher module, human intervention is required to restore the flash transfer relay to the state where the controller unit and load switches can cause the traffic signal lights to be turned ON and to be turned OFF, thereby removing the flasher module from operating the traffic signal lights.

The flasher module is capable of causing the traffic signal lights to alternate regularly OFF and ON. This is accomplished by the flasher module in such manner that traffic signal lights are flashed ON and OFF. In doing so, drivers of vehicles may see flashing red traffic signal light indications at the intersection, indicating for them to stop before proceeding through the intersection in a safe manner.

A traffic control system is normally considered as consisting of a traffic controller unit for the purpose of providing 24 volt DC input signals to one or more load switches used to turn traffic signal lights ON. A conflict monitor device is used to monitor the presence of proper alternating current field wire voltages supplied to power the traffic signal lights. When improper AC voltages exist, the conflict monitor causes an electro-mechanical relay to operate, which in turn causes the high current capacity flash transfer relay to remove traffic signal light power from the load switches and to connect the traffic signal light power to a flasher unit, which causes traffic signal lights to flash ON and OFF.

Operation of a traffic control system described above requires the supply of AC power to equipment. When AC power ceases to be supplied, the traffic control system ceases to operate and the traffic signal lights no longer emit light, thereby becoming dark. The result is that drivers of vehicles approaching the signalized intersection do not see any traffic signal lights. The drivers of vehicles approach what is typically referred to in the industry as "a dark intersection". The Manual on Uniform Traffic Control Devices (MUTCD) of the Federal Highway Administration (FHWA), listed in the Federal Register, states that it is acceptable to operate a signalized intersection as "a dark intersection" and that, during such operation, drivers of vehicles are expected to interpret "a dark intersection" the same as they would an intersection having stop signs; stopping their vehicles before proceeding through the intersection.

One of the purposes of traffic signals is to make intersections more visible, and hence, safer. There has long been need for improvements in making "a dark intersection" more visible to drivers of vehicles for traffic control. Traffic signal lights may be difficult to see even when operating properly and lit. But when traffic signal lights are dark, intersections become very difficult for drivers of vehicles to see. The result is that accidents occur, causing property damage and bodily harm with potential loss of life. Power outages leading to loss of traffic signal light operation are most likely to occur as the result of inclement weather, which causes visibility to be degraded. Thus, the loss of traffic signal operation most commonly occurs when its reliable operation is needed most. Loss of traffic signal light operation during nighttime due to loss of power poses an all-too-common threat to the safety of drivers of vehicles, their passengers and bystanders.

Back-up power supplies with power storage capability have been used in traffic control systems at signalized intersections to maintain operation of the traffic control system as it would operate from the external AC power source. Use of such back-up power sources has been limited to only a few signalized intersections, due to space limitations and their high cost.

SUMMARY OF THE INVENTION

It is a major object of the invention to provide an improved system meeting the above needs.

The environment of the invention comprises a traffic control system for use at a roadway intersection, the system including traffic control lights, a light flasher means, and a plurality of load switches electrically coupled with the lights via relay means to which the flasher means is connected, the load switches having inputs, and a controller connected with the load switches for controlling normal operation of the lights and flashing of one or more of the lights by the flasher means in the event of a system malfunction.

In this environment, the invention provides:

a) flasher means electrically connectible to the lights to cause the lights to come ON and OFF, repeatedly, b) an electrical power storage device electrically connected to the flasher means for supplying electrical power to operate the light flasher means when AC source power is not supplied to the traffic control system, and c) a charging device for charging the storage device when AC power is normally supplied to the traffic control system.

Another embodiment of the invention provides a voltage disconnect device operatively connected with said storage device for preventing feed-back of stored power to selected elements of said control system when AC power is not being supplied to the system.

A further object is to provide a control system that includes i) load switches corresponding to said traffic control lights for supplying AC power thereto, ii) a conflict monitor circuit, iii) relay means operatively connected between said load switches and said control lights, and to said flasher means, and controlled by said monitor circuit, to remove a connection for power transmission via the load switches to the control lights, and to connect power transmission from the flasher means to said lights.

Yet another object is to provide a conflict monitor which includes measuring circuitry to measure the presence or absence of predetermined or selected AC field wire voltages at outputs defined by the load switches, whereby if the measured voltages are not at predetermined levels, the monitor determines that a malfunction has occurred, so that corrective action can be taken.

An additional object is to provide a controller or controllers, to control DC voltages that turn the load switches ON or OFF, the monitor operatively connected to said controller or controllers to monitor DC voltage, whereby if the DC voltage falls below a threshold level required for operation of the system, the monitor determines that a malfunction has occurred, and initiates corrective action.

These and other objects and advantages of the invention, as well as the details of an illustrative embodiment, will be more fully understood from the following specification and drawings, in which:

DRAWING DESCRIPTION

DETAILED DESCRIPTION

Figure 1:
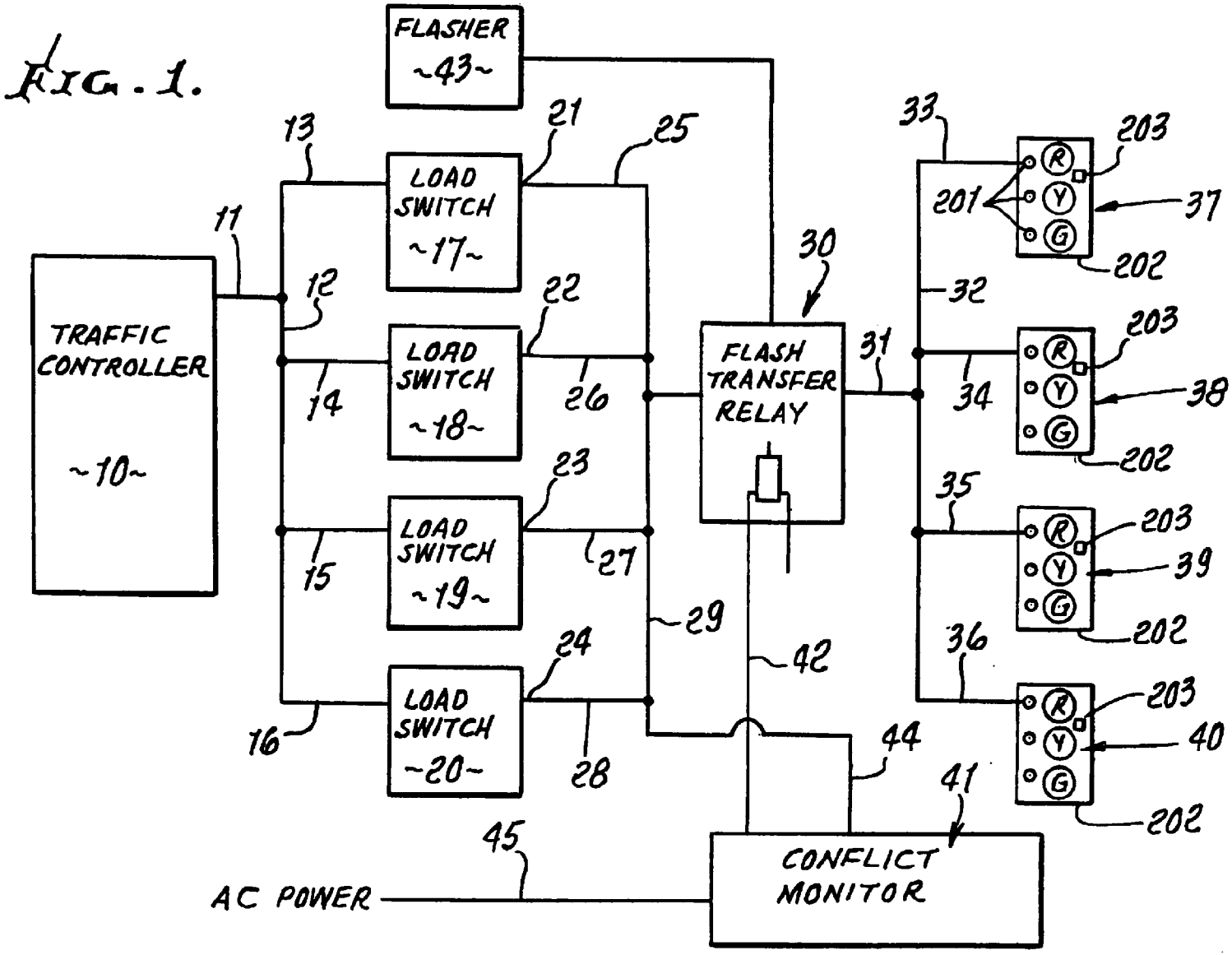
FIG. 1 is a preferred system block diagram.

In FIG. 1, a traffic controller is indicated at 10, as having output at 11, connected at 12–16 with load switches 17–20. Such switches have outputs at 21–24 connected at 25–29 with flash transfer relay means 30, which is in turn connected at 31–36 with traffic control light units 37–40. The latter are normally located at different corners of a roadway intersection. When a system malfunction or a power failure occurs, typically red lights in units 37–40 are placed in a flashing mode. This is accomplished by the high current capacity relay means 30, which receives a flash initiating signal from a conflict monitor 41, via connection 42. The relay removes power transmission from the load switches normally connected via the relay to the respective four lights, and connects power transmission from the flasher circuit 43 to relevant light units. Relay means 30 is connected between 29 and 31, as shown.

The conflict monitor 41 is shown as operatively connected with the load switches 17–20 via connection 44, whereby the monitor 41 measures the presence or absence of predetermined or selected AC field wire voltages at the outputs 21–24 of the switches 17–20, for example for appropriate AC voltage level supplied to the light units from the load switches. When AC field wire voltages at the outputs of the switches 17–20 are not appropriate, such as insufficient, the conflict monitor 41 determines that a malfunction has occurred and initiates corrective action. Also, the conflict monitor 41 monitors the DC voltage from the controller 10 that is used to turn each load switch output ON. If the DC voltage is below the minimum level required for operation of the traffic control system, the monitor 41 determines that a malfunction has occurred and initiates corrective action. Via AC connection 45, the monitor 41 measures the AC supply voltage used to power equipment within the traffic control system which includes traffic controller 10, load switches 17–20, Flash Transfer Relay 30, Flasher 43 and Conflict Monitor 41, to ensure there is an adequate voltage level to operate the traffic control system. When the AC power voltage is below the minimum level required for operation of the traffic control system, the monitor 41 determines that a malfunction has occurred and initiates corrective action. In doing so, it is intended that monitor 41 causes the relay 30 to transfer electrical power connection to the traffic signal lights 37–40 from the load switches 17–20 to the flasher 43, whereby the flasher then operates the signal lights 37–40.

Transfer of operation of the traffic signal lights 37–40 to the flasher 43 will not cause operation of the lights if external AC power is insufficient to operate the flasher 43 and the traffic signal lights 37–40.

Figure 2:
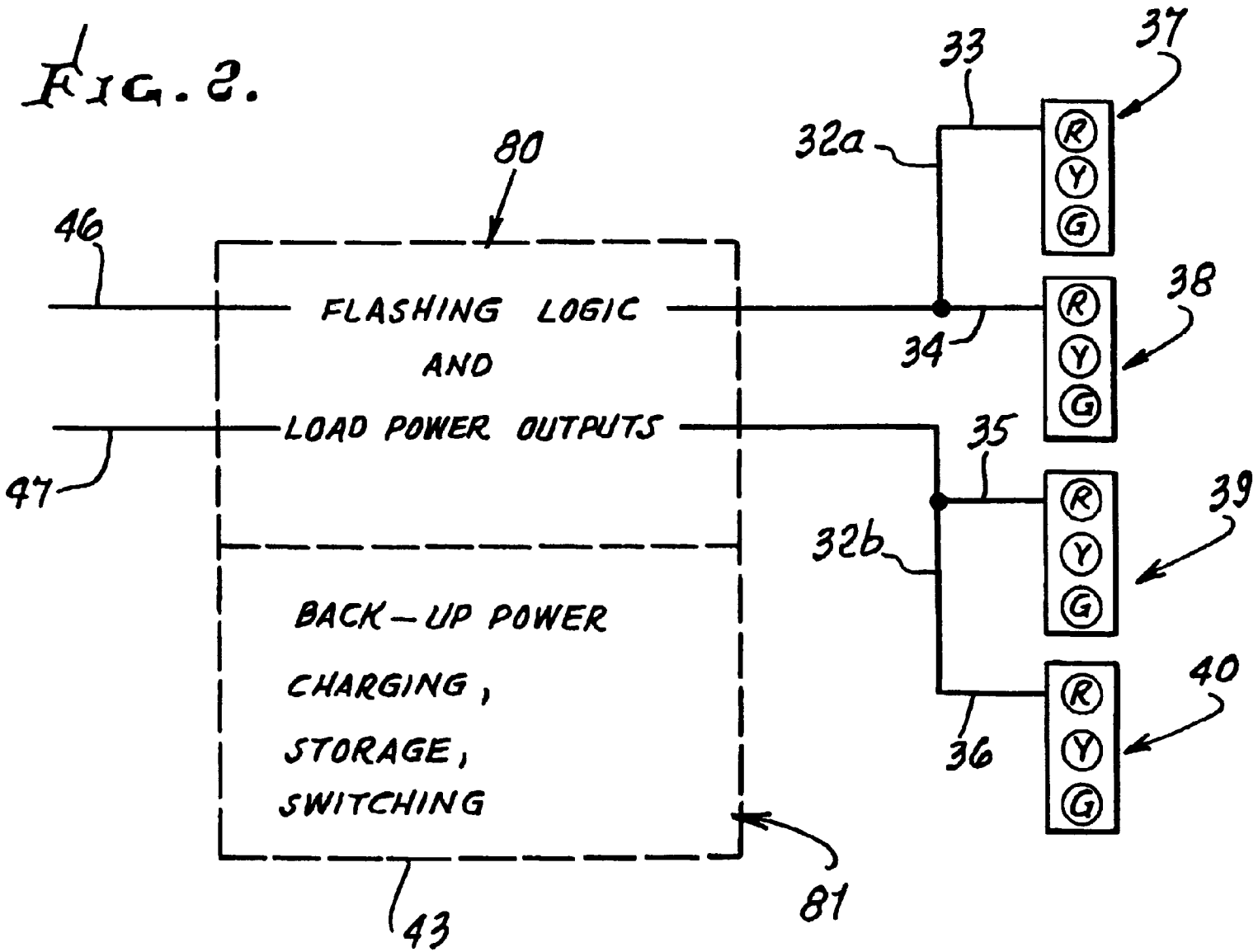
FIG. 2 is a flasher block diagram.

FIG. 2 shows a block diagram of improvements provided by this invention for the flasher 43 which cause the traffic signal lights 37–40 to flash when AC power service supplied at 46 and 47 is below the voltage level necessary to operate the flasher 43 and the traffic signal lights 37–40. This invention causes flasher unit operation under conditions when flasher units and traffic signal lights have previously been unable to operate, thus resulting in traffic signal lights becoming visible under conditions previously not possible. The flasher 43 is shown divided into two generalized circuit elements. One element indicated at 80 contains flashing logic and load power outputs connected as shown to the traffic signal lights 37–40. The other element indicated at 81 contains back-up power charging, storage and switching circuitry for operating the flashing logic and load power outputs as well as the traffic signal lights, when AC power service at 46 and 47 is insufficient to cause traffic control system operation.

Figure 3:
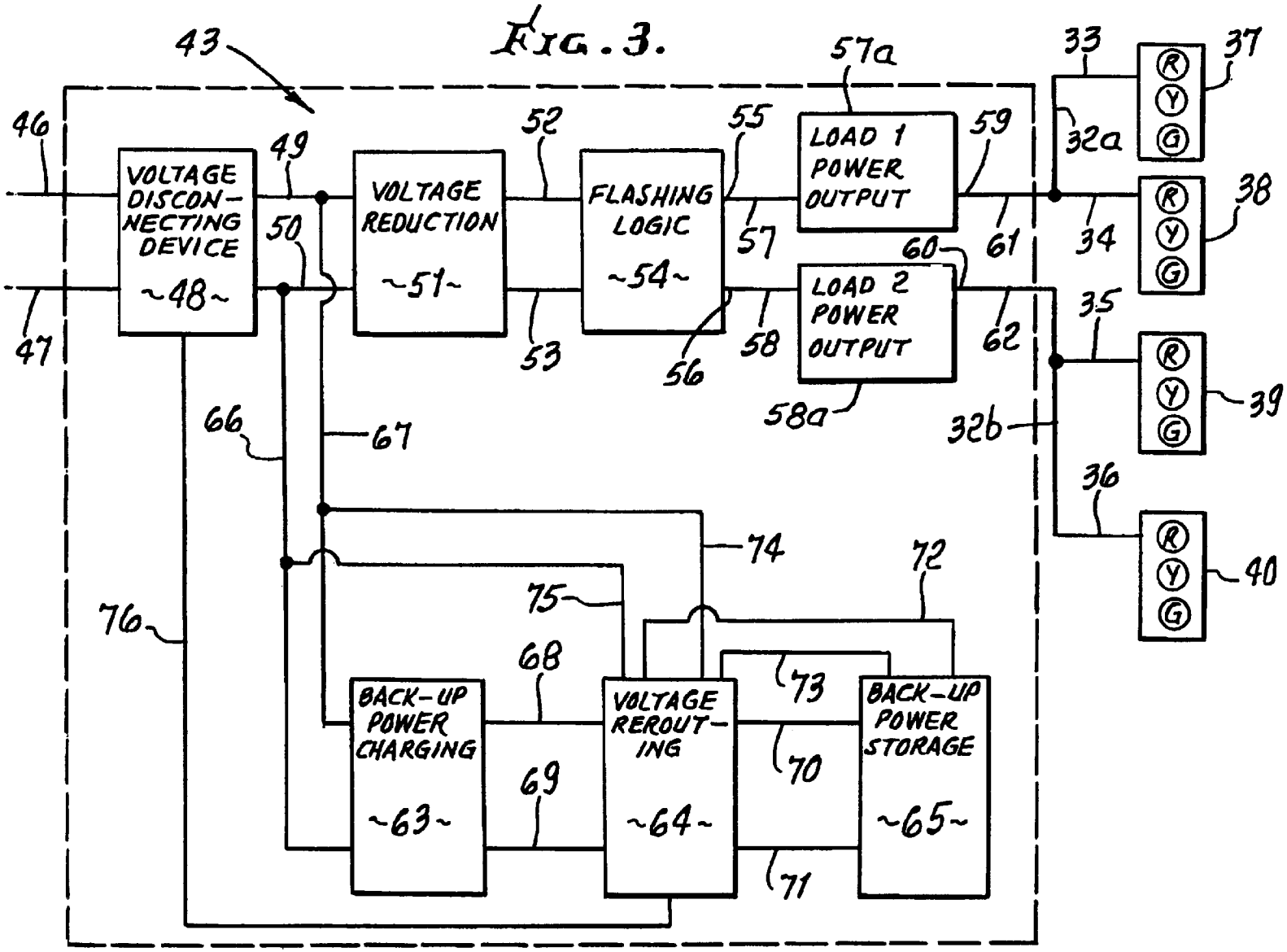
FIG. 3 is a flasher detail diagram.

FIG. 3 presents further details describing improvements in operation. AC line voltage 46 and AC common voltage 47 enter the flasher 43 through a voltage disconnecting device 48 connected through paths 49 and 50 to voltage reduction circuitry 51. The flasher unit 43 furthermore contains flashing logic 54 powered through connections 52 and 53 from the voltage reduction circuitry 51. Such flashing logic 54 has outputs 55 and 56 connected at 57 and 58 to flasher load power output circuitry 57*a* and 58*a*. Such flasher load power is delivered to the signal light loads through connections 61 and 62 from its outputs at 59 and 60. Flasher power outputs 57*a* and 58*a* have sufficient current-carrying capacity to accommodate the traffic signal light loads 37–40. Connection 61 supplies power to lights 37 and 38; and connection 62 supplies power to lights 39 and 40.

Operation of the flasher 43 during times when AC line voltage 46 and AC common voltage 47 are below required levels occurs by virtue of the back-up power charging circuit 63, the voltage rerouting control circuitry 64, and the back-up power storage unit 65 for example interconnected as shown. During times when AC line voltage 46 and AC common voltage 47 are at levels sufficient to operate the flasher 43, the back-up charging circuit or device 63 is activated through connections 66 and 67. The back-up charging circuit or device 63, such as an AC/DC converter, converts the AC line voltage 46 and AC common voltage 47 to DC voltage needed to charge the back-up power storage unit 65 such as a battery. The voltage rerouting circuitry is connected via connection 76 to the voltage disconnecting device. The voltage rerouting circuit 64 is also connected to the back-up power charging circuit 63 and to the back-up power storage unit 65, through connections 68–71 as shown. The voltage rerouting control circuitry 64 provides several control functions. The first is to enable DC voltage produced from the back-up charging circuit 63 to be delivered to the back-up power storage unit 65 during times when the AC line voltage 46 and AC common voltage 47 are sufficient for operation of the flasher 43, during which time it causes the voltage disconnecting device 48 to remain connected to the AC line voltage 46 and AC common voltage 47. A second function occurs during times when the AC line voltage 46 and AC common voltage 47 are not sufficient for operation of the flasher 43 to cause the voltage disconnecting device 48 to remove the flasher elements from connection to the external power supply through 46 and 47 while simultaneously disconnecting from connections 68 and 69 and enabling connections 74 and 75 to connections 67 and 66. This causes stored power from the back-up power storage 65 to be delivered through connections 72 and 73, and ultimately to input connections 49 and 50. A third function of the voltage rerouting control circuitry 64 is to convert the DC voltage output of the back-up power storage unit 65 into voltage needed to operate the flashing logic and load power outputs within the flasher 43. Appropriate switches are contained within 64.

Figures 4, 4A, 4B, 4C:
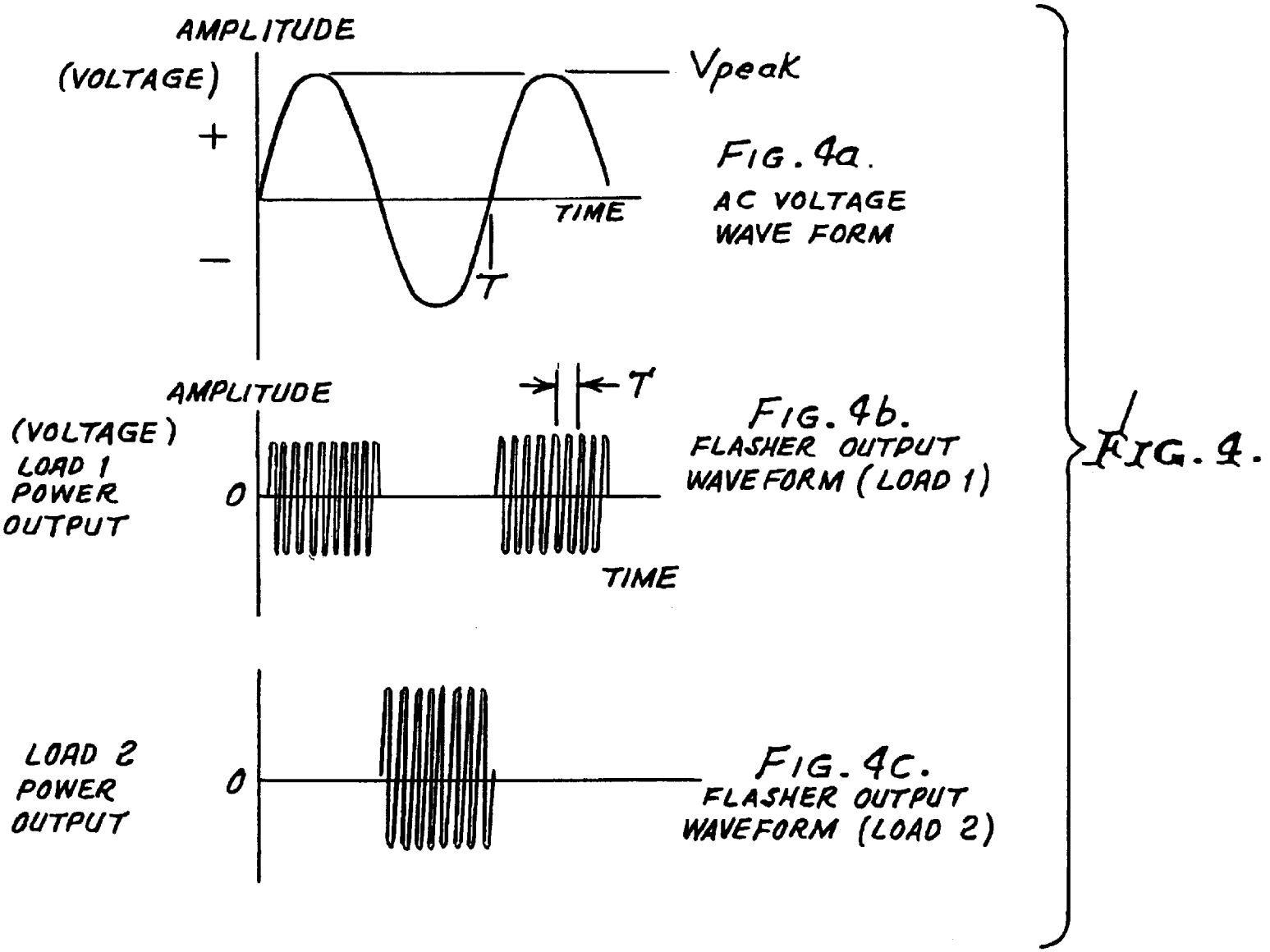
FIG. 4 shows waveform diagrams, at 4(*a*), 4(*b*) and 4(*c*)

FIG. 4 presents waveforms within which FIG. 4(*a*) shows the standard AC voltage sine wave of peak voltage amplitude, $V_{peak}$, and period, T, equal to 1/frequency. For 60 Hertz frequency AC the period is 16.6667 milliseconds. Industry standards such as those set by the FHWA define the period for the flasher 43 outputs 59 and 60 as 50 to 60 flashes/minute with an on period of 50+/−5 percent. FIGS. 4(*b*) and 4(*c*) present the waveforms for the flasher 43 outputs 59 and 60 where the AC waveform of FIG. 4(*a*) would typically be observed to be superimposed upon the flasher load power outputs 59 and 60.

The aforementioned elements, connections and functions may be implemented in separate units, within a single flasher unit or within the traffic signal light or lights and achieve the same desired results of self-powered flashing operation. Implementations in other structural ways, are contemplated.

It will be understood that the traffic signal lights may include LED's indicated at 201 which require minimum electrical power. Also, the housings 202 for the LED's at the signal lights may receive or house elements of the control circuitry referred to above, and indicated at locations 203, within the housings. As a result, the back-up power storage unit 65 is required to supply only the minimum current needed for LED operation.

Figure 7:
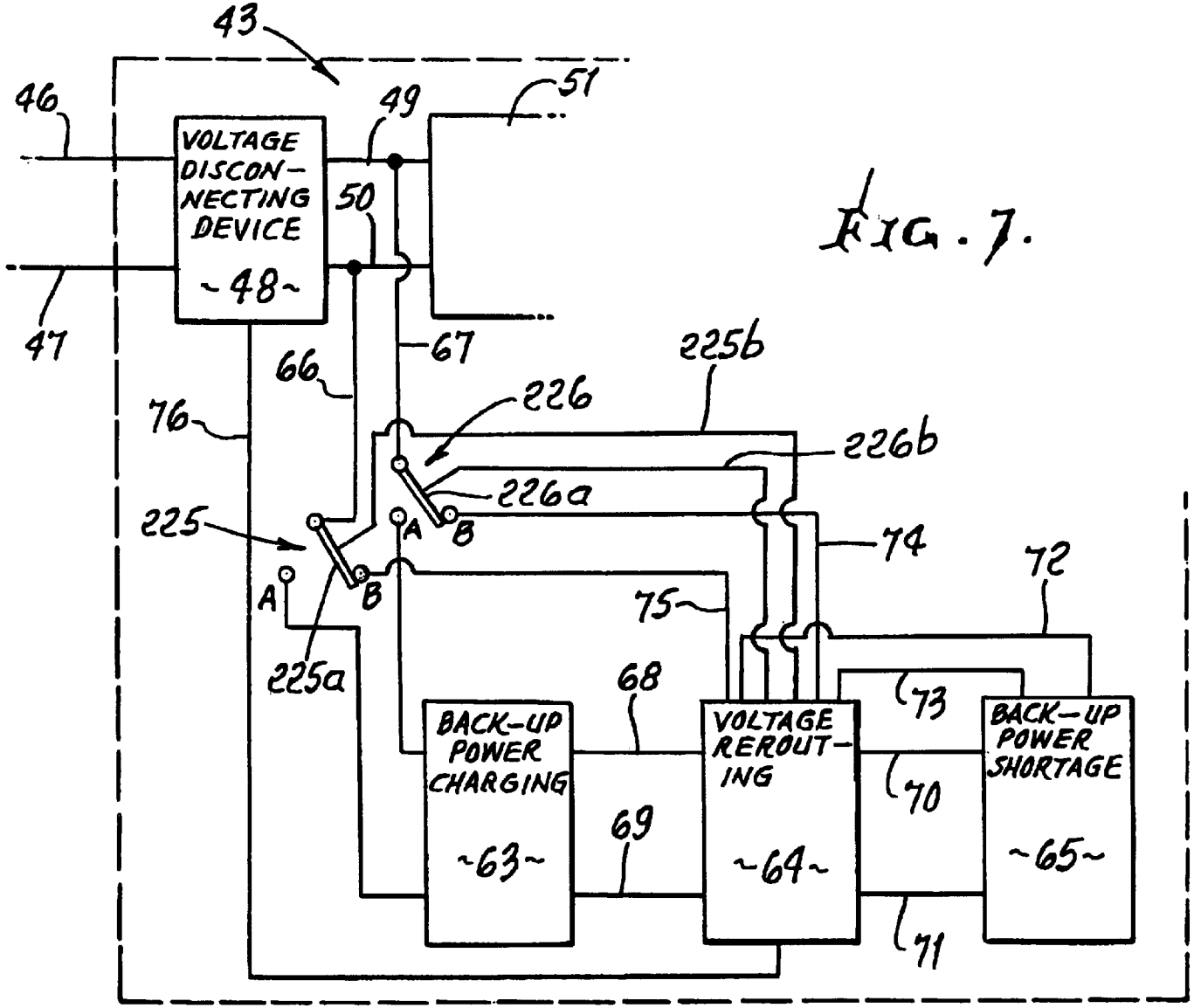
FIG. 7 is a further modified block diagram.

In FIG. 7, two single pole, double throw relays 225 and 226 are provided and connected as shown. The arm 225*a* of relay 225 is operated from circuitry 64, via control line 225*b*; and arm 226*a* of relay 226 is operated from circuitry 64, via control line 226*b*. Relay 225, when operated, enables connection of line 75 to connecting line 66; and relay 226, when operated, enables connection of line 74 to connecting line 67. The relays are equivalent to double pole, double throw relays.

The two relays 225 and 226 appear in position B. This would be the state when a power failure had occurred and 46 and 47 were below voltage thresholds established as sufficient for traffic control system operation. When the relays 225 and 226 are in position B, the back-up power system 81 will power flasher elements 51, 54, 57*a* and 58*a*, thereby causing the traffic signals 37, 38, 39 and 40 to be lit. This is the state where the invention performs its novel, unique and useful function. FIG. 7 shows element 43 (the flasher) connected to the traffic signal lights 37–40 as the result of flash transfer relay 30 being in the transferred state wherein the flasher is connected to the traffic signal lights. (The other state of the flash transfer relay 30 is where the load switches 17–20 are connected to the traffic signal lights 37–40.)

While FIG. 1 shows traffic signal lights 37–40 as being connected each by single connections 33–36, it is clear from the symbols used for 37–40 that each traffic signal is comprised of three separate color indicating traffic signal light modules, i.e., R(=red), Y(=yellow) and G(=green). Application of the invention may also benefit from inclusion of a sub-figure detailing three separate electrical connections from the three separate outputs (R, Y and G) of one load switch to a traffic signal light. These connections could be referenced as 25*a*, 25*b* and 25*c* from load switch 17 and 33*a*, 33*b* and 33*c* to the traffic signal light 37. FIG. 1 and subsequent figures need not be complicated by showing these additional lines. But, the sub-figure would then have laid the groundwork for describing the invention in its most commonly anticipated usage of flashing the red traffic signal light modules as opposed to unlikely use of flashing green traffic signal light modules.

Figure 8:
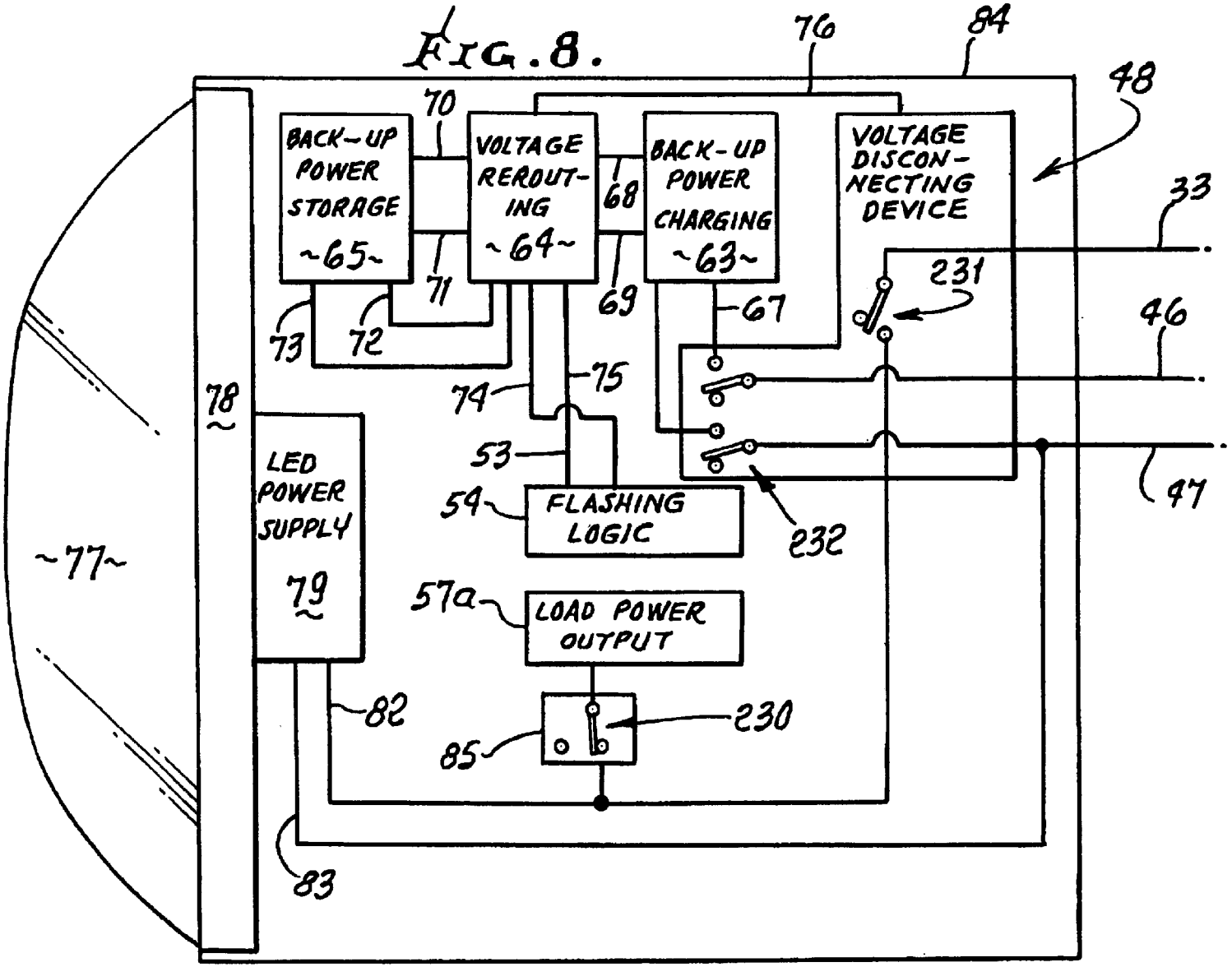
FIG. 8 shows a modified location of the FIG. 3 circuitry.

FIG. 8 shows circuitry as in FIG. 3, located within a traffic light housing 84. A traffic light lens and LED light array are indicated at 77 and 78. The operational state shown is during AC power levels insufficient for traffic signal operation. Elements illustrated are listed as follows:

| FIG. 8 traffic signal light with LED module | |
|---|---|
| 46 | AC line voltage |
| 47 | AC common voltage |
| 48 | voltage disconnecting device |
| 63 | back-up power charging |
| 64 | voltage rerouting |
| 65 | back-up power storage |
| 68 | electrical connection |
| 69 | electrical connection |
| 70 | electrical connection |
| 71 | electrical connection |
| 72 | electrical connection |
| 73 | electrical connection |
| 74 | electrical connection |
| 75 | electrical connection |
| 76 | electrical connection |
| 77 | lens or cover |
| 78 | light emitting diode (LED) array |
| 79 | LED module internal power supply |
| 82 | electrical wire, line |
| 83 | electrical wire, common |
| 84 | housing |
| 85 | relay |

Figure 9:
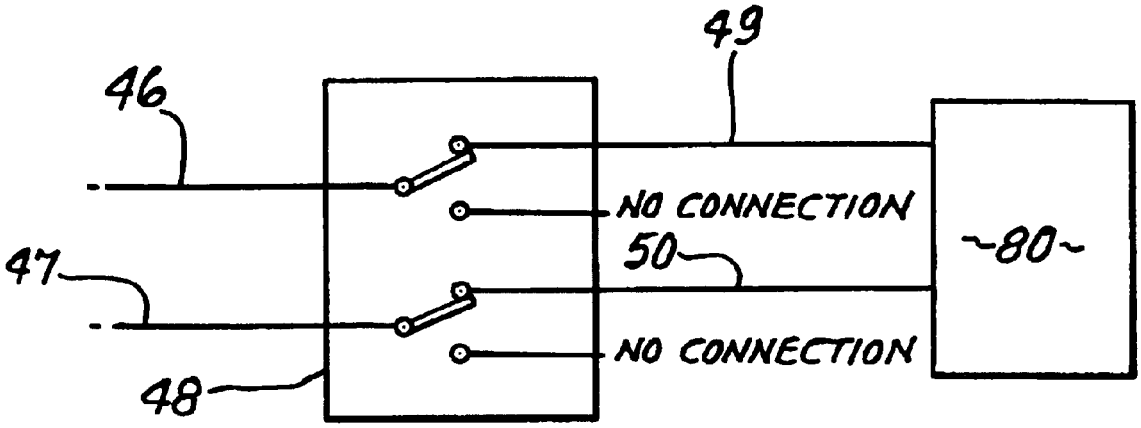
FIGS. 9 and 10 are circuit diagrams.
Figure 10:
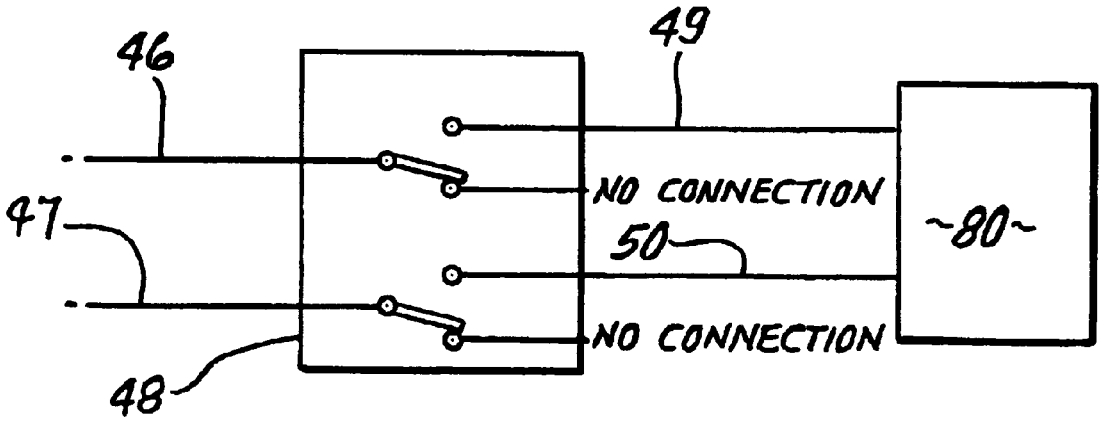

The voltage disconnecting device 48 in FIG. 8 may be considered to be the equivalent of a relay, as shown in FIGS. 9 and 10. FIG. 9 shows connections from AC line 46 and AC common 47 made to the flashing logic and load power outputs 80 when there is sufficient AC voltage to operate the traffic control system. When AC voltage drops below the threshold level, the voltage disconnecting device 48 removes 80 from 46 and 47, as shown in FIG. 10. Thus, AC voltage sensing circuitry is used in conjunction with 48.

This invention enables the use of its elements, (herein stated as being separate), within fewer or combined elements, or may be separated further into additional elements, so as to still perform the same functions being described herein. In particular, 48 may be combined with the two relays 225 and 226. Also, a plurality of relays may be used in various locations between the elements of this invention during its implementation, an example of such usage being shown in FIG. 8, the relays indicated at 230, 231, 232 and 233.

Figure 5:
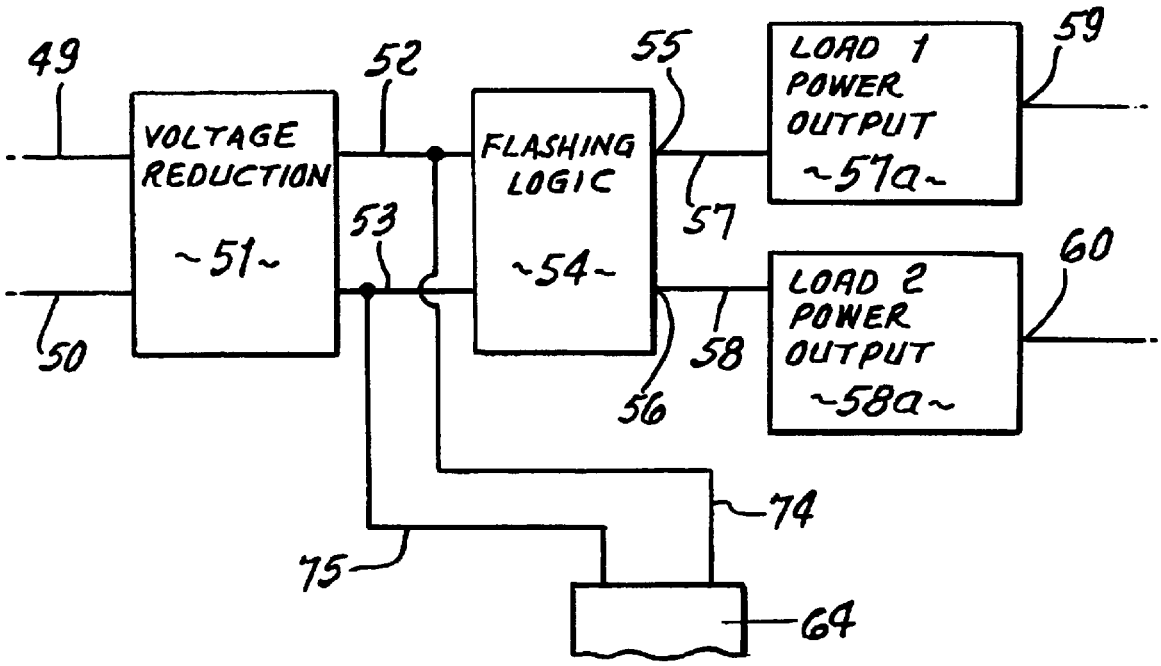
FIGS. 5 and 6 are modified block diagrams.

Element 64 in FIG. 8 also performs the useful function of generating proper voltages for use within the invention. Element 64 takes the DC voltage stored within element 65 and causes power to be delivered to flasher elements within 80 such that flashing of traffic signal lights will reliably result. In doing so, element 64 may act as an AC-inverter producing AC voltage of a type and form sufficient to allow for proper operation of flasher elements within 80. One example of connections providing this capability is shown in FIG. 3 with connection to element 51 via 49 and 50. Another example of this invention is where element 64 produces reduced AC voltage of a type and form compatible to allow its connection to element 54 via 52 and 53, such as indicated in FIG. 5. Other examples of this invention encompass element 64 delivering pulsed DC voltage instead of AC voltage to element 54 via 52 and 53, as well as to element 57*a* and element 58*a* whether both elements 57*a* and 58*a* are utilized or whether just one is incorporated within application of this invention. Accordingly, the invention is not limited to the shape or amplitude or periodicity of voltages supplied to cause flasher elements to operate, so long as the applied voltages are sufficient to cause the flasher to operate at all.

Elements 63 and 64 in FIG. 8 may be combined to yield a DC charger/AC inverter with internal switching between these two functions and to charge/discharge the battery 65.

The use of relay 230 at 85 is optional and is intended to isolate leakage of voltage from flasher output 61, thereby preventing undesirable illumination of the LED array 78 at times when AC voltage at 46 and 47 are sufficient for normal operation of the traffic control system. Voltage leakage without incorporation of relay 230 may be expected to occur when the load switch connected to the traffic signal light module is in its OFF state (i.e., when traffic controller 10 has not caused the load switch to turn ON as the result of not having controlled DC voltage to be delivered to the load switch) and the flasher is in its OFF state.

Another embodiment of the invention provides traffic signal lights which include within them a:

a) flasher means electrically connectible to the lights, b) an electrical power storage device electrically connected to the flasher means, c) a charging device for charging the storage device.

A further object is to provide a voltage disconnect device operatively connected with said storage device.

Figure 6:
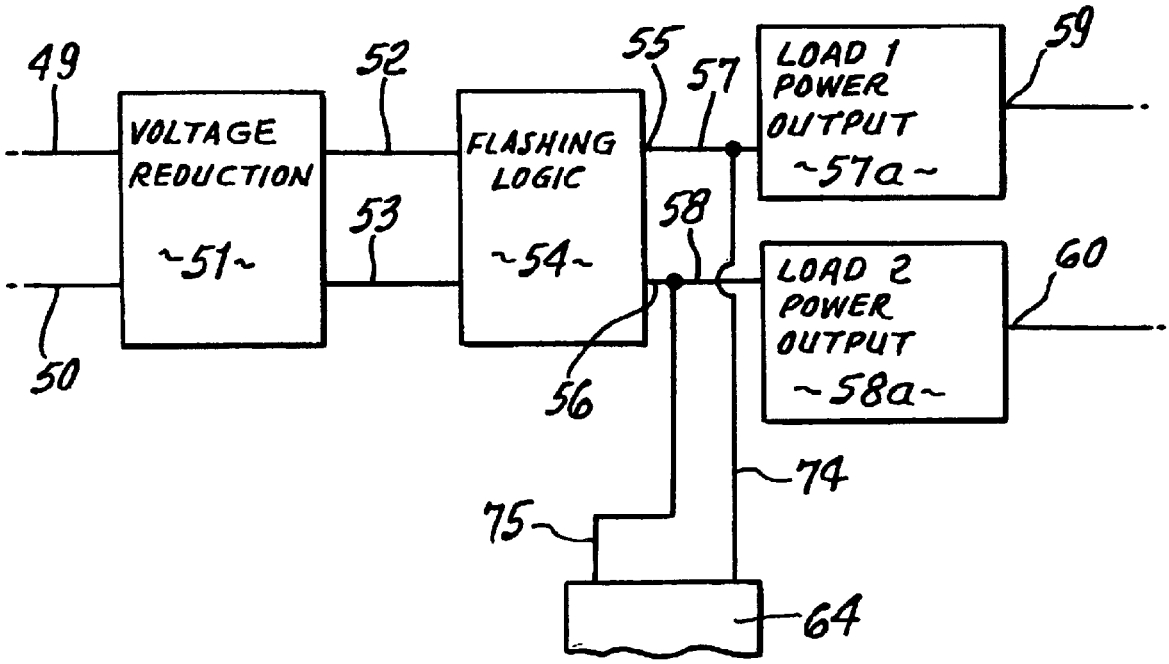

FIG. 3 shows connections 74 and 75 made to connections 67 and 66. This implies that the voltage rerouting control circuitry 64 supplies AC voltage at a level comparable with that normally delivered through AC line voltage 46 and AC common voltage 47. Another embodiment of the invention is where connections 74 and 75 are instead made to connections 52 and 53, respectively. In this case, AC voltage having a lower voltage is delivered from voltage rerouting control circuitry 64 to flashing logic 54. See FIG. 5. The invention also encompasses modifications of examples shown and descriptions provided herein where defined flasher elements may be rearranged or reconnected, and also where DC voltages may be applied on-and-off so as to produce the same results of the invention described herein. An example is exhibited in FIG. 6.

This invention may supply either AC, DC or DC on-and-off to the flasher 43 or to its elements.

Accordingly, the invention provides selective features such as:

i) a voltage disconnect device operatively connected with said storage device of preventing feed-back of stored power to selected elements of said control system when AC power is not being supplied to the system, ii) relay means operatively connected between said load switches and said control lights, and to said flasher means, and controlled by said monitor circuit, to remove power transmission via the load switches to the control lights, and to connect power transmission from the flasher means to said lights, iii) a conflict monitor which includes circuitry to measure the presence or absence of predetermined or selected AC field wire voltages at outputs defined by the load switches, whereby if the measured voltages are not at predetermined levels, the monitor circuit determines that a malfunction has occurred, so that corrective action can be taken, iv) a controller to control DC voltages that turn the load switches ON or OFF, the monitor operatively connected to said controller or controllers to monitor said DC voltages, whereby if the DC voltage falls below a threshold level required for operation of the system, the monitor circuit determines that a malfunction has occurred, and initiates corrective action, v) LED traffic lights operable by the flasher means powered by an electric power storage device, in lieu of AC power supply.

We claim:

1. In a control system for controlling only existing traffic signal lights, that are normally supplied with power from the AC source, the combination comprising a) flasher means electrically connectible to the lights to cause the existing lights to come ON and OFF, repeatedly, b) an electrical power storage device electrically connectible to the flasher means for supplying electrical power to operate the flasher means when AC source power is not supplied to the existing traffic control system, and c) a charging device for charging the storage device when AC power is normally supplied to the traffic control system, d) and including a voltage re-routing control circuitry operatively connected with said charging device and said power storage device, for activating said charging device at times when AC line voltage is sufficient to operate said flasher means.

2. The combination of claim 1 wherein said charging device is associated with the traffic control lights.

3. The combination of claim 1 including a voltage disconnect device operatively connected with said storage device for preventing feed-back of stored power to selected elements of said control system when AC power is not being supplied to the system.

4. The combination of claim 3 wherein said voltage disconnect device is associated with said traffic control lights.

5. The combination of claim 1 wherein the control system includes:

i) load switches corresponding to said traffic signal lights for supplying AC power thereto, ii) a conflict monitor circuit, and iii) relay means operatively connected between said load switches and said control lights, and to said flasher means, and controlled by said monitor circuit, to remove power transmission via the load switches to the control lights, and to connect power transmission from the flasher means to said lights.

6. In a control system for controlling traffic signal lights, that are normally supplied with power from the AC source, the combination comprising a) flasher means electrically connectible to the lights to cause the lights to come ON and OFF, repeatedly, b) an electrical power storage device electrically connectible to the flasher means for supplying electrical power to operate the flasher means when AC source power is not supplied to the traffic control system, and c) a charging device for charging the storage device when AC power is normally supplied to the traffic control system, d) and control system including i) load switches corresponding to said traffic signal lights for supplying AC power thereto, ii) a conflict monitor circuit, and iii) relay means operatively connected between said load switches and said control lights, and to said flasher means, and controlled by said monitor circuit, to remove power transmission via the load switches to the control lights, and to connect power transmission from the flasher means to said lights.

e) and wherein the conflict monitor circuit includes measuring circuitry to measure the presence or absence of predetermined or selected AC field wire voltages at outputs defined by the load switches, whereby if the measured voltages are not at predetermined levels, the monitor circuit determines that a malfunction has occurred, so that corrective action can be taken.

7. The combination of claim 6 including a controller or controllers to control DC voltages that turn the load switches ON or OFF, the monitor operatively connected to said controller or controllers to monitor said DC voltages, whereby if the DC voltage falls below a threshold level required for operation of the system, the monitor circuit determines that a malfunction has occurred, and initiates corrective action.

8. The combination of claim 7 including voltage re-routing control circuitry operatively connected with said charging device and said power storage device, for activating said charging device at times when AC line voltage is sufficient to operate said flasher means.

9. The combination of claim 1 wherein said charging device includes an AC to DC converter.

10. The combination of claim 8 wherein said charging device includes an AC to DC converter.

11. The combination of claim 1 including a voltage disconnecting device operatively connected between a AC power source and said flasher means to disconnect said flasher means from said power source when power source voltage falls below a predetermined level and before said power storage device is connected to the existing traffic signal lights.

12. The combination of claim 11 including a voltage re-routing control circuitry operatively connected with said charging device and said power storage device, for activating said charging device at times when AC line voltage is sufficient to operate said flasher means, and wherein said voltage re-routing control circuitry is operatively connected to said voltage disconnecting device to effect said disconnecting of the flasher means from the AC power source, an to substitute connection of said power storage device to said flasher means.

13. The combination of claim 12 wherein said charging device includes an AC to DC converter.

14. The combination of claim 1 including said existing traffic lights which incorporate LED light sources.

15. The combination of claim 14 including housings for said LED traffic lights, said flasher means located in at least one of said housings.

16. The combination of claim 1 including switching means to control switching of power supply to the flasher means from AC line power to DC power from said power storage device, in response to a decrease in AC power voltage level to or below a predetermined threshold.

17. The method of providing and operating a control system for controlling only existing traffic signal lights, normally supplied with power from an AC source, which includes the steps:

a) providing flasher means electrically connectible to the lights to cause the lights to come ON and OFF, repeatedly, b) providing an electrical power storage device electrically connectible to the flasher means for supplying electrical power to operate the flasher means when AC source power is not supplied to the existing traffic control system, and c) providing a charging device acting to charge the storage device when AC power is normally supplied to the traffic control system, d) and providing voltage re-routing control circuitry operatively connected with said charging device and said power storage device, for activating said charging device at times when AC line voltage is sufficient to operate said flasher means.

18. The method of claim 17 wherein said charging device is provided in association with the traffic signal lights.

19. The method of claim 17 including providing a voltage disconnect device operatively connected with said storage device and operating to prevent feed-back of stored power to selected elements of said control system when AC power is not being supplied to the system.

20. The method of claim 19 wherein said voltage disconnect device is provided in association with said traffic signal lights.

21. The method of claim 17 wherein the control system is provided to include:

i) load switches corresponding to said traffic signal lights for supplying AC power thereto, ii) conflict monitor circuit, and iii) relay means operatively connected between said load switches and said control lights, and to said flasher means, and controlled by said monitor circuit, to remove power transmission via the load switches to the control lights, and to connect power transmission from the flasher means to said lights.

22. The method of providing and operating a control system for controlling traffic signal lights, that are normally supplied with power from an AC source, which includes the steps:

a) providing flasher means electrically connectible to the lights to cause the lights to come ON and OFF, repeatedly, b) providing an electrical power storage device electrically connectible to the flasher means for supplying electrical power to operate the flasher means when AC source power is not supplied to the traffic control system, and c) providing a charging device acting to charge the storage device when AC power is normally supplied to the traffic control system, d)said control system provided to include:

i) load switches corresponding to said traffic signal lights for supplying AC power thereto, ii) a conflict monitor circuit, and iii) relay means operatively connected between said load switches and said lights, and to said flasher means, and controlled by said monitor circuit, to remove power transmission via the load switches to said lights, and to connect power transmission from the flasher means to said lights, e) wherein the conflict monitor circuit is provided to include measuring circuitry to measure the presence or absence of predetermined or selected AC field wire voltages at outputs defined by the load switches, whereby if the measured voltages are not at predetermined levels, the monitor circuit determines that a malfunction has occurred, so that corrective action can be taken.

23. The method of claim 22 wherein a controller or controllers is or are provided to control DC voltages that turn the load switches ON or OFF, the monitor circuit operatively connected to said controller or controllers to monitor said DC voltages, whereby if the DC voltage falls below a threshold level required for operation of the system, the monitor circuit determines that a malfunction has occurred, and initiates corrective action.

24. The method of claim 23 including providing a voltage re-routing control circuitry operatively connected with said charging device and said power storage device, and operating to activate said charging device at times when AC line voltage is sufficient to operate said flasher means.

25. The method of claim 17 wherein said charging device is provided to include an AC to DC converter.

26. The method of claim 17 including providing a voltage disconnecting device operatively connected between an AC power source and said flasher means and operating to disconnect said flasher means from said power source when power source voltage falls below a predetermined level.

27. The method of claim 26 including providing voltage re-routing control circuitry operatively connected with said charging device and said power storage device, and operating to activate said charging device at times when AC line voltage is sufficient to operate said flasher means, and wherein said voltage re-routing control circuitry is operatively connected to said voltage disconnecting device and operating to effect said disconnecting of the flasher means from the AC power source, and to substitute connection of said power storage device to said flasher means.

28. The method of claim 17 including providing aid traffic lights to incorporate LED light sources.

29. The method of claim 17 including providing switching means controlling switching of power supply to the flasher means from AC line power to DC power from said power storage device, in response to a decrease in AC power voltage level to or below a predetermined threshold.

30. The method of claim 17 wherein the control system is supplied with power from a DC voltage source.

31. The combination of claim 1 including a traffic signal light housing structure for housing said flasher means.

32. The combination of claim 31 wherein said structure houses a), b) and c) of claim 1.

33. The combination of claim 11 including voltage re-routing control circuitry operatively connected with said charging device and said power storage device, for activating said charging device at times when AC line voltage is sufficient to operate said flasher means.

34. In a control system for controlling traffic signal lights, that are normally supplied with power from an AC source, the combination comprising a) flasher means electrically connectible to the lights to cause the lights to come ON and OFF, repeatedly, b) an electrical power storage device electrically connectible to the flasher means for supplying electrical power to operate the flasher means when AC source power is not supplied to the traffic control system, and c) a charging device for charging the storage device when AC power is normally supplied to the traffic control system.

d) a voltage disconnecting device operatively connected between a AC power source and said flasher means to disconnect said flasher means from said power source when power source voltage falls below a predetermined level and before said power storage device is connected to the existing traffic signal lights, e) voltage re-routing control circuitry operatively connected with said charging device and said power storage device, for activating said charging device at times when AC line voltage is sufficient to operate said flasher means, f) and including a line or lines connected between said charging device and the output side of said voltage disconnecting device.

35. The combination of claim 34 including a relay or relays in series with said line or lines, operated by said voltage re-routing control circuitry.

36. The combination of claim 33 including a voltage reduction circuitry operatively connected between said voltage disconnecting device and said flasher means.

37. In a control system for controlling traffic signal lights, that are normally supplied with power from an AC source, the combination comprising a) flasher means electrically connectible to the lights to cause the lights to come ON and OFF, repeatedly, b) an electrical power storage device electrically connectible to the flasher means for supplying electrical power to operate the flasher means when AC source power is not supplied to the traffic control system, and c) a charging device for charging the storage device when AC power is normally supplied to the traffic control system, d) a voltage disconnecting device operatively connected between a AC power source and said flasher means to disconnect said flasher means from said power source when power source voltage falls below a predetermined level, e) a voltage re-routing control circuitry operatively connected with said charging device and said power storage device, for activating said charging device at times when AC line voltage is sufficient to operate said flasher means, f) and including a control line or lines connected between said voltage re-routing control circuitry and the output side of said voltage reduction can circuitry.

38. In a control system for controlling traffic signal lights, that are normally supplied with power from an AC source, the combination comprising a) flasher means electrically connectible to the lights to cause the lights to come ON and OFF, repeatedly, b) an electrical power storage device electrically connectible to the flasher means for supplying electrical power to operate the flasher means when AC source power is not supplied to the traffic control system, and c) a charging device for charging the storage device when AC power is normally supplied to the traffic control system, d) a voltage disconnecting device operatively connected between an AC power source and said flasher means to disconnect said flasher means from said power source when power source voltage falls below a predetermined level, d) a voltage re-routing control circuitry operatively connected with said charging device and said power storage device, for activating said charging device at times when AC line voltage is sufficient to operate said flasher means, f) and a control line or lines connected between said voltage re-routing control circuitry and the output side of said flasher means.

* * * * *